US008237311B2

(12) United States Patent
Roth

(10) Patent No.: US 8,237,311 B2
(45) Date of Patent: Aug. 7, 2012

(54) SWITCHING DEVICE

(75) Inventor: Herbert Roth, Altdorf (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 129 days.

(21) Appl. No.: 12/618,208

(22) Filed: Nov. 13, 2009

(65) Prior Publication Data

US 2010/0061038 A1 Mar. 11, 2010

Related U.S. Application Data

(63) Continuation of application No. PCT/EP2008/002980, filed on Apr. 15, 2008.

(30) Foreign Application Priority Data

Jun. 15, 2007 (DE) ..... 10 2007 027 522

(51) Int. Cl.
*H01H 19/64* (2006.01)
*H01H 47/00* (2006.01)

(52) U.S. Cl. ..... 307/113

(58) Field of Classification Search ..... 307/113
See application file for complete search history.

(56) References Cited

U.S. PATENT DOCUMENTS 5,638,255 A * 6/1997 Bobadilla et al. ..... 361/624
5,875,087 A * 2/1999 Spencer et al. ..... 361/87
6,496,358 B2 * 12/2002 Kanemaru et al. ..... 361/601
2005/0213289 A1 * 9/2005 M'Sadoques et al. ..... 361/624
2009/0146766 A1 6/2009 Loos et al.

FOREIGN PATENT DOCUMENTS

| | | | |
|---|---|---|---|
| DE | 197 09 814 | A1 | 9/1998 |
| DE | 299 19 378 | U1 | 1/2000 |
| DE | 102 43 383 | B3 | 2/2004 |
| DE | 10 2006 027 140 | A1 | 12/2007 |
| EP | 1 220 257 | A1 | 7/2002 |
| EP | 1 610 416 | A2 | 12/2005 |

OTHER PUBLICATIONS

International Search Report, dated Sep. 16, 2008.

* cited by examiner

*Primary Examiner* — Rexford Barnie
*Assistant Examiner* — Dru Parries
(74) *Attorney, Agent, or Firm* — Laurence A. Greenberg; Werner H. Stemer; Ralph E. Locher

(57) ABSTRACT

An electrical switching device which enables an electrical system, particularly a power distribution system, is structured rationally and simply. The switching device, in particular embodied in the form of a rail-mounted device, contains a housing and, included therein, a switching unit for interrupting an electrical circuit, and a supply connection for feeding a current to the switching unit. The supply connection has a first coupling contact for connecting to a current busbar, a load connection for connecting a feed conductor of a load circuit to the switching unit, and a return connection which has a connecting terminal for connecting to the return conductor of the load circuit and a second coupling contact connected to the connecting terminal inside the housing for connecting to a second current busbar.

13 Claims, 3 Drawing Sheets

SWITCHING DEVICE

CROSS-REFERENCE TO RELATED APPLICATION

This is a continuation, under 35 U.S.C. §120, of copending international application No. PCT/EP2008/002980, filed Apr. 15, 2008, which designated the United States; this application also claims the priority, under 35 U.S.C. §119, of German patent application No. DE 10 2007 027 522.8, filed Jun. 15, 2007; the prior applications are herewith incorporated by reference in their entirety.

BACKGROUND OF THE INVENTION

Field of the Invention

The invention relates to an electrical switching device, in particular in the form of a rail-mounted device.

An electrical switching device, such as for example a circuit breaker, a mechanical, electronic or mechatronic switch or a relay, usually has a supply connection, by which a mains-side and therefore current-feeding current conductor can be connected, and a load connection by which a load-side outgoing current conductor can be connected.

An electrical installation with a plurality of electrical load circuits to which current is fed from a common main current conductor and which are connected to a common current return is described generally in the following as a power distribution system. Switching devices are usually provided as part of such a power distribution system, particularly at the branch points at which the load circuits branch from the main current conductor. Here, the switching device serves to electrically isolate the associated load circuit from the current-feeding main current conductor when required. With switching devices which are configured in the form of rail-mounted devices, the supply connection sometimes includes a coupling connection that can be connected to a current-feeding current busbar which spans a plurality of switching devices for the purpose of simplifying the connection of a plurality of parallel load circuits. In such an installation, the current is usually returned from the load circuits separately from the switching devices by separate circuit elements. Although switching devices are frequently provided with additional signal connections from which information can be obtained relating to the switching state of the switching device, as a rule, these signal connections are configured for low-power electrical currents and are neither intended nor suitable for returning current from the load circuits.

SUMMARY OF THE INVENTION

It is accordingly an object of the invention to provide a switching device which overcomes the above-mentioned disadvantages of the prior art devices of this general type, which enables an electrical system, particularly a power distribution system, to be structured rationally and simply.

With the foregoing and other objects in view there is provided, in accordance with the invention an electrical switching device. The electrical switching device contains a housing, a switching unit for interrupting an electrical circuit and disposed in the housing, and a supply connection for feeding a load current to the switching unit and is disposed in the housing. The supply connection has a first coupling contact for connecting to a current busbar. A load connection is provided for connecting a feed conductor of load circuit to the switching unit, and the load connection is disposed in the housing. A return connection is provided and has a connecting terminal for connecting to a return conductor of the load circuit. The return connection further has a second coupling contact connected to the connecting terminal inside the housing and is provided for connecting to a second current busbar.

Accordingly, the switching device contains a switching unit, a supply connection, a load connection and a return connection in a common housing.

The switching unit is optionally configured in the form of a mechanical, electronic or mechatronic switch, but preferably in the form of a circuit breaker, and serves generally for interrupting an electrically conducting connection between the supply connection and the load connection. The supply connection serves to feed a current to the switching unit. In a power distribution system, the supply connection serves to connect the switching device to the current-feeding main current conductor. For this purpose, it contains a first coupling contact which is configured for connecting to a first (current-feeding) current busbar. The load connection is configured to be connected to the feed conductor of an electrical load circuit.

The additional return connection provided according to the invention serves to divert the load current from the load circuit to the main current return conductor. On the one hand, it contains a connecting terminal to which the (load current-carrying) return conductor of the load circuit can be connected. Furthermore, the return connection contains a second coupling contact which is configured for connecting to a second (current return) current busbar. The connecting terminal and the coupling contact of the return connection are short-circuited inside the housing. With an electromechanical switch (or circuit breaker), the return connection is preferably electrically insulated with respect to all other electrical functional parts and conductors of the switching device. On the other hand, when the switching device is configured as an electronic switch (or circuit breaker), the return connection preferably also serves as a ground connection for the electronic functional parts of the switching device.

Integrating the return connection into the switching device enables a power distribution system to be built up in a particularly simple manner from a number of switching devices arranged next to one another in a row, wherein, apart from the switching devices themselves, basically only the current busbars, which correspond to the coupling contacts and which in this case act as main current conductors which feed and return the current respectively, are required to realize the power distribution system. In this way, an electrical system, in particular a power distribution system, can be realized with very few circuit components and therefore, on the one hand, rationally and, on the other, with low installation and space requirements. Notwithstanding this, the individual switching device can likewise be used within the framework of conventional individual wiring. The switching device can therefore be used extremely flexibly as part of an electrical system.

In particular, the switching device is configured in the form of a so-called rail-mounted device. In this respect, the housing has a profiled mounting (clip-on slot) on a rear side for attaching the switching device to a mounting rail. The side of the housing opposite the rear side is referred to as the housing front, and faces an operator when the switching device is in the intended installed position. The profile direction of the mounting (and of the mounting rail associated therewith) defines a row direction along which a plurality of switching devices can be arranged next to one another in the manner intended in the assembled state. The sides of the housing perpendicular to this row direction are referred to as the housing faces. In accordance with the intended installed position of the switching device, the two remaining sides of the housing are referred to as the housing top and housing bottom respectively.

In a preferred embodiment of the switching device at least one of the coupling contacts, but preferably each coupling contact, is arranged in a respectively associated housing slot which passes completely through the housing in the row direction. If a plurality of switching devices are arranged next to one another in a row, then the or each housing slot aligns with the associated housing slots of the other switching devices. This enables the use of a current busbar which is configured as a profile part and which is pressed into the aligned housing slots and is therefore safely shielded by the housing against contact.

Arranging preferably at least one, in particular each coupling contact, and where appropriate the housing slot corresponding thereto, on the housing front, enables the current busbars to be installed particularly easily, which can also be carried out in an electrical cabinet, particularly under restricted space conditions, without any problems. In addition, as a result of arranging the coupling contacts at the front of the housing, the current busbars are still visible when the switching device is installed in an electrical cabinet, which enhances the clarity of an electrical system equipped with the switching devices.

Likewise for the purpose of wiring the switching device particularly easily and clearly, it is preferably provided that the load connection and the return connection be arranged on a common housing side, in particular the housing bottom, so that both conductors of the load circuit associated with the switching device are connected to the switching device on the same housing side. On the other hand, in an advantageous further development of this idea, the supply connection is arranged on a housing side opposite this housing side, in particular on the housing top. In this way, the current-feeding main current conductor and the load circuit are particularly clearly spatially separated.

In an expedient embodiment, the supply connection in addition to the coupling contact also contains a connecting terminal connected in parallel therewith for connecting a conductor. In this case—in contrast to the rigid current busbar—a flexible wire or lead is referred to as a conductor.

To increase operating safety, the or each housing slot is expediently sized in such a way that it accommodates the associated coupling contact in a finger-safe manner. In particular, this enables the switching device to be used in individual wiring systems, i.e. without the use of a current busbar, without the housing slot having to be covered for safety reasons. The finger-safe configuration of the housing slot is particularly advantageous when the housing slot is arranged on the easily accessible housing front in the installed position.

In an advantageous further development, the switching device also contains at least one signal connection from which a switching signal can be obtained which is characteristic for the switching state of the switching unit, and which can therefore be used as a basis for determining the switching state of the switching unit. The switching signal can be output in the form of an (active) current or voltage signal which is supplied from the current flowing through the switching unit for example. In this case, however, a low-current or low-voltage signal is used for the switching signal, the electrical power of which is considerably less than the power of the load current. Preferably, however, the switching signal is given by the (passive) switching state of a signal switch which is coupled to the switching state of the switching unit. Expediently, two signal connections connected to the signal switch are provided in this case. In an expedient embodiment of the switching device, the signal connection, or at least one of the signal connections, in turn contains a coupling contact for connecting a signal current bar, the coupling contact in turn preferably being arranged in an associated housing slot which passes completely through the housing in the row direction. The housing slot is also preferably configured in a finger-safe manner, in particular to avoid the risk of injury for users in the event of a faulty current flashover to the signal circuit. To improve user-friendliness, the or each coupling contact of the signal connection, and if appropriate the associated housing slot, are also arranged on the housing front. In contrast to the supply connection, the load connection and the return connection, the signal connections are preferably configured for low-power electrical currents which are not dangerous to the human body.

Consistent with the typical configuration of rail-mounted devices, the housing preferably has a stepped profile which includes a relatively narrow housing head and by comparison an extended housing base (which therefore protrudes over the housing head). In this case, the housing head forms a front housing section, while the housing base forms a rear housing section. In a further development of the switching device according to the invention, the supply connection and the return connection are preferably arranged in the housing base, while the load connection is arranged in the housing head. This enables the switching device to be easily wired in a comparatively tight space. In particular, the current busbars corresponding to the supply connection and the return connection are in this way "tidied away" in the assembled state into the housing base without obstructing the connection of conductors to the switching device connections.

Other features which are considered as characteristic for the invention are set forth in the appended claims.

Although the invention is illustrated and described herein as embodied in a switching device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 3:
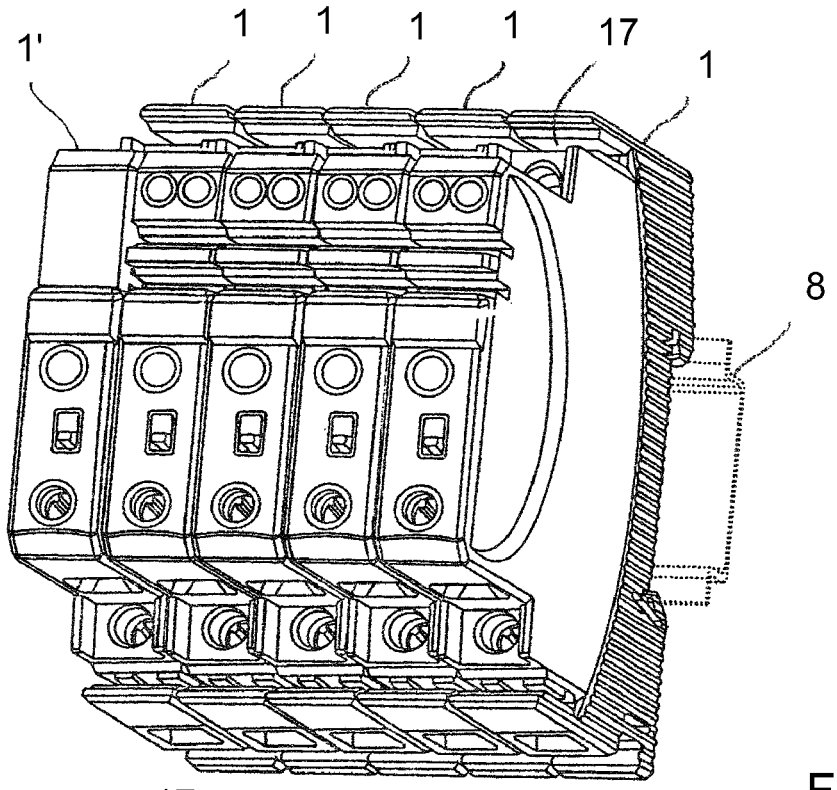
FIG. 3 is a perspective view of four switching devices according to FIG. 1 arranged next to one another in a row and a further switching device without signal connections.

Corresponding parts are given the same references in all the figures. Referring now to the figures of the drawing in detail and first, particularly, to FIG. 1 thereof, there is shown a switching device 1 shown initially viewed from the outside and contains a housing 2 made from insulating material. The switching device 1 is configured as a rail-mounted device and has a stepped housing shape, which is typical for such devices, with a housing head 3 and a housing base 4 which is extended on both sides in comparison therewith. In doing so, the housing base 4 forms a housing section which adjoins a housing back 5, and the housing head 3 forms a housing section which adjoins a housing front 6.

The switching device 1 is configured for a defined installation position in which the housing back 5 of the housing 2 faces the back of an electrical cabinet, while, in the installed position, the housing front 6 faces an operator when looking into the electrical cabinet. For installation, the switching device 1 has a clip-on slot 7 on the housing back 5 with which the switching device 1 can be clipped on to a mounting rail 8 (shown dotted in the diagram).

Figure 4:
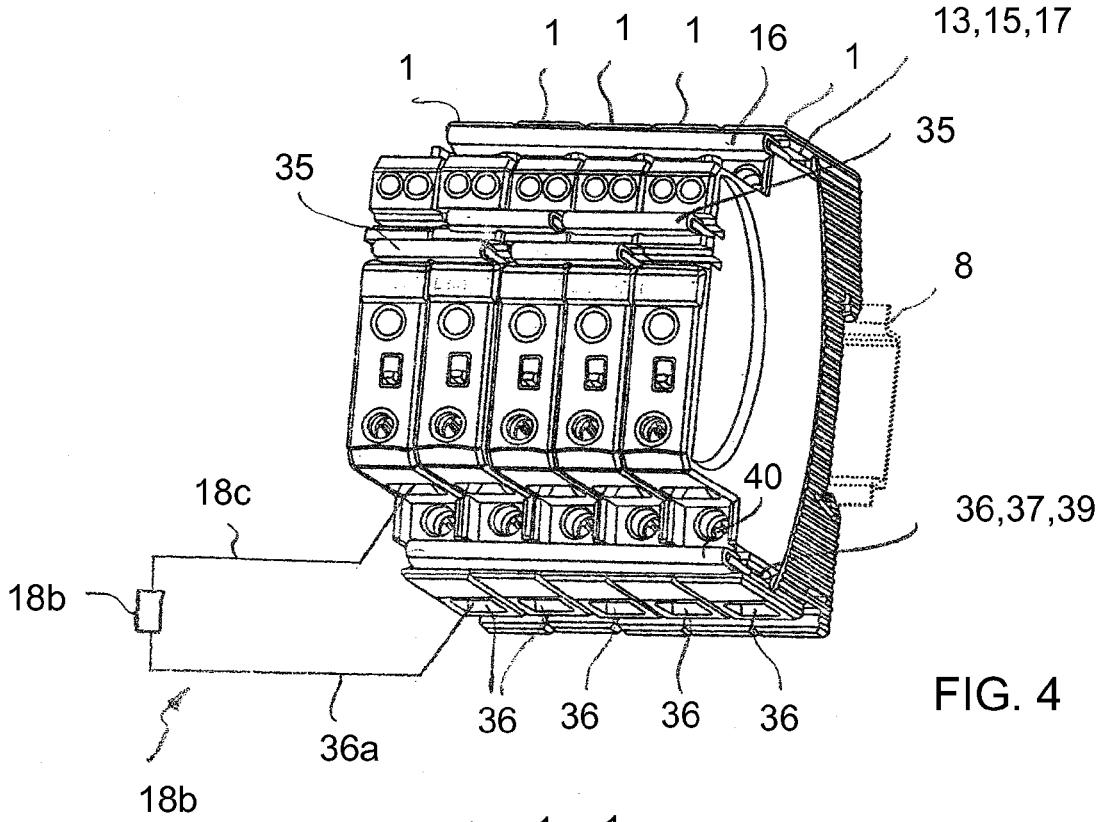
FIG. 4 is a perspective view of five switching devices according to FIG. 1 arranged next to one another in a row, the supply connections and return connections of which are connected in parallel by a current busbar in each case, and the signal connections of which are connected in series by signal current bars.
Figure 5:
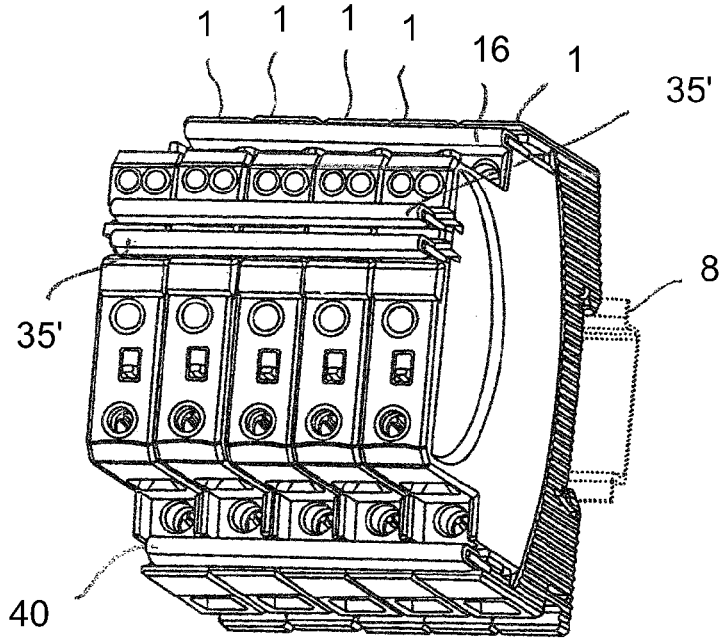
FIG. 5 is a perspective view of five switching devices arranged next to one another in a row, the supply connections and return connections of which are connected in parallel by a current busbar in each case, wherein in this case the signal connections of the switching devices are connected in parallel by signal current bars.

The profile axis of the mounting rail 8 and of the clip-on slot 7 corresponding thereto defines a row direction 9 along which a plurality of switching devices 1—as shown in FIGS. 3 to 5—can be arranged aligned in a row next to one another by clipping them on to the mounting rail 8.

The side surfaces of the housing 2 perpendicular to the row direction 9 are referred to as housing faces 10. The housing sides perpendicular to the housing faces 10, include the housing front 6, the housing back 5, a housing top 11 and a housing bottom 12 respectively—corresponding to the intended installation position of the switching device 1.

The switching device 1 has a supply connection 13, which is arranged in the area of the housing top 11, for feeding a current. The supply connection 13 contains a connecting terminal 14 configured in the form of a screw terminal to which a flexible wire or lead can be connected for feeding current. The supply connection 13 further contains a coupling contact 15 connected in parallel with the connecting terminal 14 with which a current busbar 16 (FIGS. 4 and 5) can be brought into contact. Here, the coupling contact 15 is arranged inside a housing slot 17 which opens toward the housing front 6 and which extends over the whole width of the housing in the row direction 9 and is therefore also open to the housing faces 10. At the same time, the housing slot 17 is sized in such a way that the current busbar 16 can be pressed into it to give a perfect fit.

Figure 2:
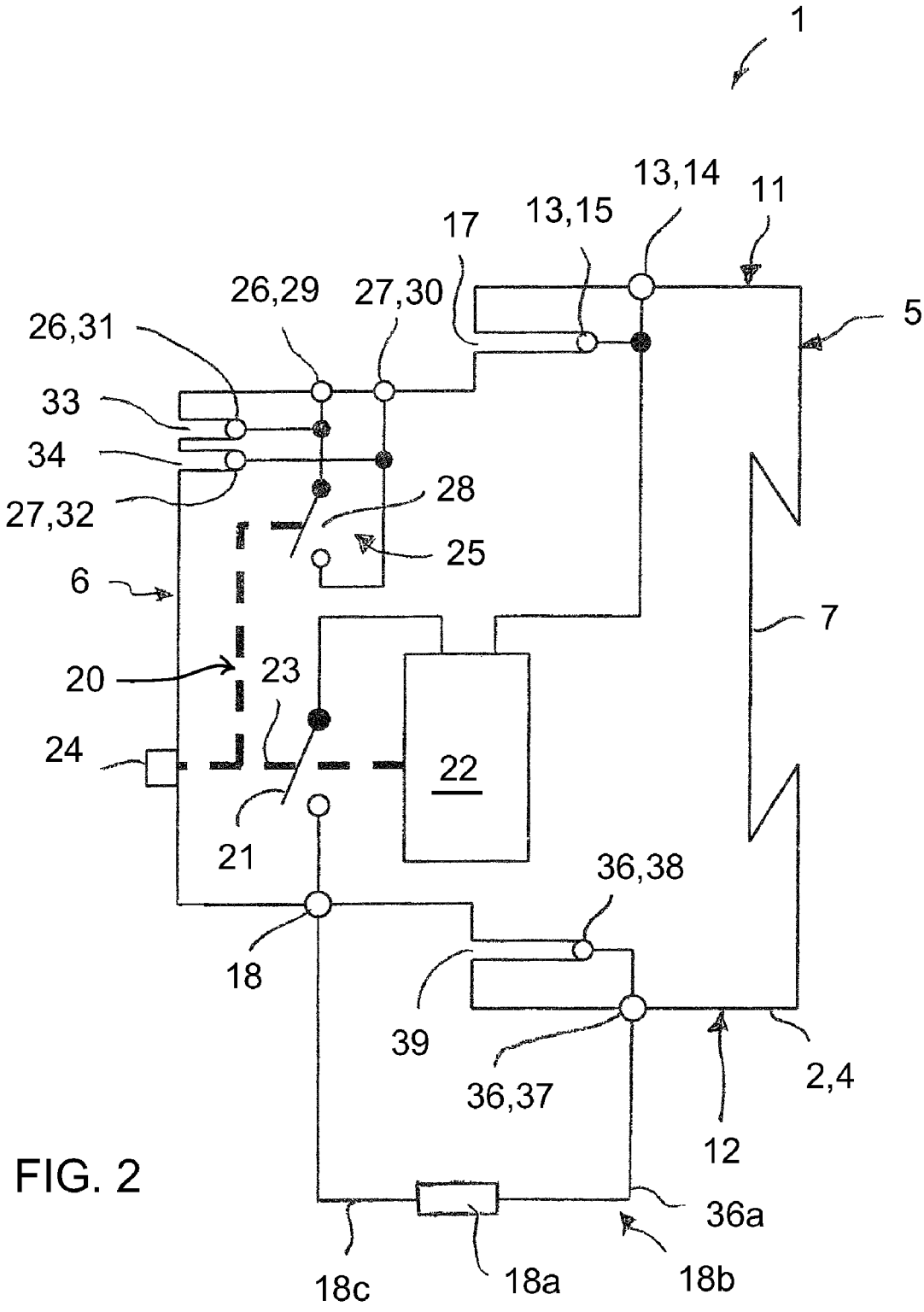
FIG. 2 is a schematic view of a circuit structure of the switching devices according to FIG. 1.

Furthermore, the switching device 1 contains a load output 18 to which a load circuit (or consumer circuit) 18*b* (FIGS. 2 and 4) containing a load 18*a* (FIGS. 2 and 4) can be connected by an associated feed conductor 18*c* (FIGS. 2 and 4). For connecting the feed conductor 18*c*, the load output 18 contains a connecting terminal 19, which is accessible from the housing bottom 12 and which is also configured in the form of a screw terminal.

The supply connection 13 and the load connection 18 are connected together inside the housing 2 via a switching unit 20 (shown in more detail in FIG. 2). In the exemplary embodiment shown, the switching unit 20 has the function of a circuit breaker, and is therefore configured to break the circuit path formed between the supply connection 13 and the load connection 18 in the event of an overcurrent. For this purpose, the switching unit 20 contains a switching contact 21 and an overcurrent trip 22. The switching contact 21 is coupled to the overcurrent trip by a switching mechanism 23 in the form of a latching mechanism so that the overcurrent trip 22 opens the switching contact 21 by the switching mechanism 23 in the event of an overcurrent. Here, the overcurrent trip 22 is based particularly on a magnetic, thermal and/or pneumatic operating principle in accordance with conventional technology.

For its part, the switching mechanism 23 is coupled to a hand operating element 24—in this case in the form of a slide or rocker lever. The hand operating element 24 is externally accessible on the housing front 6 and enables the switching contact 21 to be opened and closed manually and reversibly by the switching mechanism 23.

The switching unit 20 with the associated switching contact 21, overcurrent trip 22, switching mechanism 23 and hand operating element 24 can also be replaced by an electronic switching element. Furthermore, a signal circuit 25 is also incorporated within the switching device 1. The signal circuit 25 contains two signal contacts 26 and 27 and a signal switch 28 connected between them. Here, each of the signal contacts 26 and 27 contains a connecting terminal 29 and 30 respectively in the form of a screw terminal and a parallel-connected coupling contact 31 and 32 respectively in each case. At the same time, the connecting terminals 29 and 30 are accessible from the housing top 11 for connecting a conductor (so that only the receptacles for the terminal screws of these connecting terminals 29 and 30 are visible in the diagram of FIG. 1). The coupling contacts 31 and 32 are arranged in housing slots 33, 34 (associated with a coupling contact 31, 32 in each case), each housing slot 33, 34 in turn extending over the whole width of the housing in the row direction 9. Each of the housing slots 33 and 34 serves to accommodate a signal current bar 35, 35' (as shown in FIGS. 4 and 5).

In addition to the connections 13, 18, 26 and 27 described, the switching device 1 contains a return connection 36 which serves to connect a return conductor 36*a* (FIG. 2, 4) of the load circuit 18*b*. For this purpose, the return connection 36 contains a connecting terminal 37, which is in turn configured as a screw terminal and which is accessible from the housing bottom 12. Furthermore, the return connection 36 contains a coupling contact 38 which is connected inside the housing to the connecting terminal 37. The coupling contact 38 is arranged in a housing slot 39 near to the housing bottom 12, which in turn extends over the whole width of the housing in the row direction 9, and which opens to the housing front 6 to accommodate a current busbar 40 corresponding to the coupling contact 38 (FIGS. 4 and 5).

Figure 1:
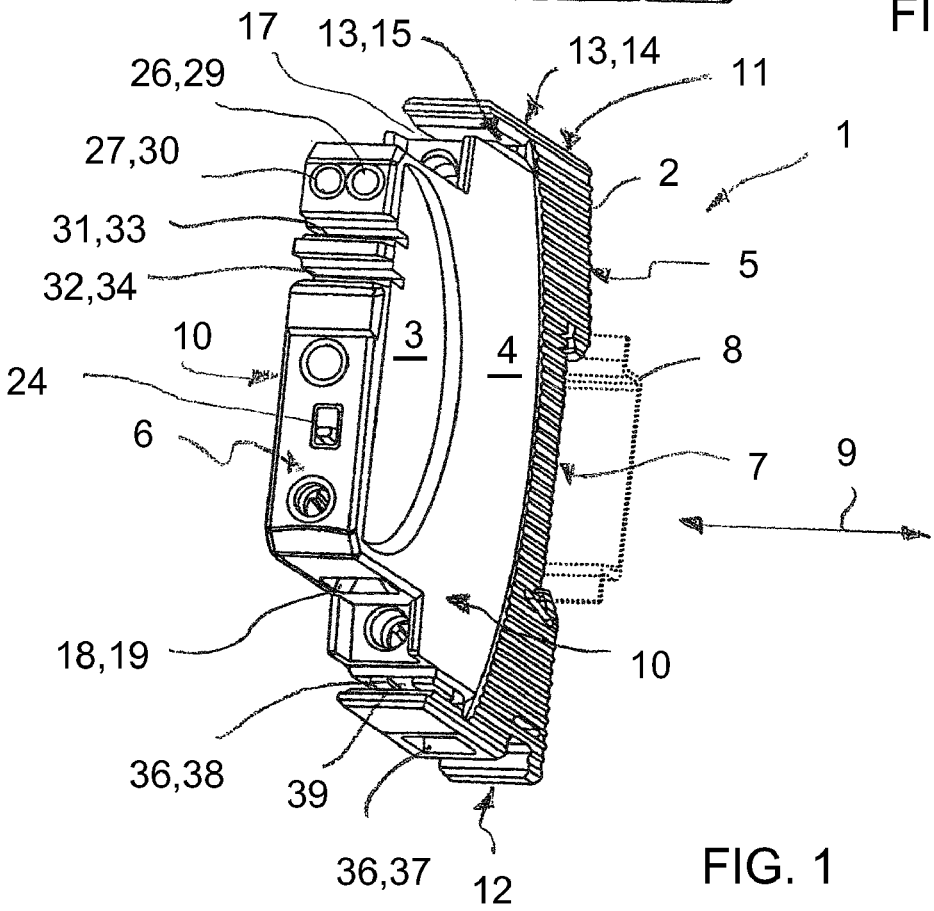
FIG. 1 is a diagrammatic, perspective view of a single switching device with a supply connection, a load connection, a return connection and two signal connections according to the invention.

Overall, as can be seen from FIG. 1, the supply connection 13 and the return connection 36 are arranged in the housing base 4, and the load connection 18 and the signal connections 26 and 27 are arranged in the housing head 3, which enables the switching device 1 to be wired in a clear and user-friendly manner.

FIG. 3 shows a plurality of switching devices 1 of the type described above arranged in a row next to one another, and by comparison a simplified switching device 1' in which the signal circuit 25 and correspondingly the associated signal connections 26 and 27 have been omitted. In particular, the modified switching device 1' can also be used as a (comparatively inexpensive) connecting module for connecting a row of switching devices 1 as part of a power distribution system.

As shown in FIGS. 4 and 5, as part of such a power distribution system, the supply connections 13 of the switching devices 1 (and 1'), which are arranged next to one another in a row, are connected in parallel by pressing the current busbar 16 into the aligned housing slots 17 of the switching devices 1 (and 1') and thus connecting it with the coupling contacts 15. Here, the length of the current busbar 16 is such that it extends over the whole width of all the switching devices 1 (and 1') to be incorporated into the power distribution system. The switching devices 1 (and 1') thereby connected in parallel are connected to an external voltage source by wiring any one switching device 1 (or 1') conventionally by its connecting terminal 14.

Likewise, the return connections 36 of the switching devices 1 (and 1') arranged next to one another in a row are connected in parallel with one another by pressing the current busbar 40 into the housing slot 39, the current busbar 40 or the connecting terminal 37 being connected to an electrical return potential, in particular ground. As part of the power distribution system, a load circuit 18*b* is preferably associated with each of the switching devices 1 (and 1'). The connection of the load circuits 18*b* for one of the switching devices 1 is shown by way of example in FIG. 4. Optionally—as mentioned above—a further switching device 1 (or 1') is provided, which serves only to connect the current busbars 16 and 40 to the external voltage supply or to ground, and to which therefore no dedicated load circuit is assigned. The individual load circuits 18*b* are connected to the respectively assigned switching device 1 (or 1') by connecting the feed conductor 18*c* of the respective load circuit 18*b* to the load connection 18 of the switching device 1 (or 1'), and the return conductor 36*a* of the load circuit 18*b* to the connecting terminal 37 of the switching device 1 (or 1').

By connecting the coupling contacts 31 and 32 of the signal connections 26 and 27 respectively in different ways to the signal current bars 35 and 35' respectively, the signal circuits 25 of the switching devices 1 arranged next to one another in a row can be connected together differently. In this regard, FIG. 4 shows a configuration of a power distribution system containing five switching devices 1 in which the signal circuits 25 of the switching devices 1 are connected together in series. FIG. 5 shows an alternative configuration of the distribution system in which the signal circuits 25 are connected in parallel. Besides these, any combinations of parallel and series connections of the signal circuits 25 are possible. In addition, one or more signal circuits 25 can also be wired individually via the connecting terminals 29 and 30.

The invention claimed is:

1. An electrical switching device, comprising:

a housing configured as a rail-mounted device and having a rear side, a front side, two side faces, a top side and a bottom side;

a switching unit for interrupting an electrical circuit and disposed in said housing;

a supply connection for feeding a load current to said switching unit and disposed in said housing, said supply connection having a first coupling contact for connecting to a current busbar, said first coupling contact disposed in said housing and being accessible from outside said housing for connecting to the current busbar from outside said housing;

a load connection for connecting a feed conductor of load circuit to said switching unit, said load connection disposed in said housing; and a return connection having a connecting terminal for connecting to a return conductor of the load circuit and a second coupling contact connected to said connecting terminal inside said housing for connecting to a second current busbar, said second coupling contact disposed in said housing and being accessible from outside said housing for connecting to the second current busbar from outside said housing;

said housing having a housing slot formed therein and passing completely through said housing in a row direction, said housing slot dimensioned such that said housing slot is a finger-safe slot, and in each case only one of said first and second coupling contacts is disposed in said housing slot.

2. The switching device according to claim 1, wherein:

said housing has a housing front; and at least one of said first and second coupling contacts is disposed on said housing front.

3. The switching device according to claim 1, wherein said load connection and said return connection are disposed on a common housing side.

4. The switching device according to claim 3, wherein said supply connection on the one hand and said return connection and said load connection on the other are disposed on mutually opposite housing sides.

5. The switching device according to claim 1, wherein said supply connection has a connecting terminal connected in parallel with said first coupling contact for connecting a conductor.

6. The switching device according to claim 1, wherein said housing slot is sized such that said housing slot accommodates at least one of said first and second coupling contacts in a finger-safe manner.

7. The switching device according to claim 1, further comprising at least one signal connection from which a switching signal can be obtained which is characteristic for a switching state of said switching unit.

8. The switching device according to claim 7, wherein said signal connection has a coupling contact for connecting to a signal current bar.

9. The switching device according to claim 8, wherein:

said coupling contact of said signal connection is disposed in said housing slot.

10. The switching device according to claim 8, wherein:

said housing has a housing front; and said coupling contact of said signal connection is disposed on said housing front.

11. The switching device according to claim 1, wherein:

said housing has a stepped profile with a housing head adjoining said front side; and said housing has a housing base protruding over said housing head and adjoins said rear side of said housing, said supply connection and said return connection are disposed in said housing base, and said load connection is disposed in said housing head.

12. The electrical switching device according to claim 1, wherein the electrical switching device is a rail-mounted device.

13. A power distribution system, comprising:

a first current busbar;

a second current busbar;

at least two switching devices disposed next to one another in a row in a row direction, each of said switching devices containing:

a housing configured as a rail-mounted device and having a rear side, a front side, two side faces, a top side and a bottom side;

a switching unit for interrupting an electrical circuit and disposed in said housing;

a supply connection for feeding a load current to said switching unit and disposed in said housing, said supply connection having a first coupling contact connected to said first current busbar, said first coupling contact disposed in said housing and being accessible from outside said housing for connecting to the current busbar from outside of said housing;

a load connection for connecting a feed conductor of a load circuit to said switching unit, said load connection disposed in said housing; and a return connection having a connecting terminal for connecting to a return conductor of the load circuit, said return connection further having a second coupling contact connected to said connecting terminal inside said housing and further connected to said second current busbar, said second coupling contact disposed in said housing and being accessible from outside said housing for connecting to the second current busbar from outside of said housing;

said housing having a housing slot formed therein and passing completely through said housing in a row direction, said housing slot dimensioned such that said housing slot is a finger-safe slot, and in each case only one of said first and second coupling contacts is disposed in said housing slot;

said first coupling contacts of said supply connections are short-circuited by means of said first current busbar, and said second coupling contacts of said return connections are short-circuited by means of said second current busbar; and the feed conductor of the load circuit corresponding to said switching device being connected in each case to said load connection of each of said switching devices, and the return conductor of the load circuit being connected in each case to said connecting terminal of said return connection of said switching device.

* * * * *